US005416993A

United States Patent [19]

Shields

[11] Patent Number: 5,416,993

[45] Date of Patent: May 23, 1995

[54] CARD ASSEMBLY WITH COLLAPSIBLE FRAME

[75] Inventor: Karl N. Shields, Bainbridge Is., Wash.

[73] Assignee: Dib Dab Design, Inc., Bellevue, Wash.

[21] Appl. No.: 147,292

[22] Filed: Nov. 5, 1993

[51] Int. Cl.[6] ..... G09F 1/04

[52] U.S. Cl. ..... 40/124.1; 40/155

[58] Field of Search ..... 40/124.1, 155, 539, 40/152

[56] References Cited

U.S. PATENT DOCUMENTS 2,080,997 5/1937 Beckelman ..... 40/155

FOREIGN PATENT DOCUMENTS 1098680 8/1955 France ..... 40/124.1

*Primary Examiner*—Kenneth J. Dorner
*Assistant Examiner*—Cassandra Davis
*Attorney, Agent, or Firm*—Christensen, O'Connor, Johnson & Kindness

[57] ABSTRACT

The card assembly is made up of (1) a face element having a rectangular opening having a top, bottom and two sides, (2) top, bottom and side frame parts, (3) a carrier for the card, and (4) an illustration. The illustration is adhered to the carrier. The top frame part is hinged to the top of the rectangular opening and has a slot in it parallel to its hinge line and along the bottom edge of the portion of the top frame part which is visible with the assembly in its in use state. A tab on the top end of the carrier extends through the slot from front to back. The bottom end of the carrier is hinged to the top edge of the bottom frame part and the bottom edge of that part is hinged to the bottom of the rectangular opening. In the closed or flat state the bottom frame part is folded flat against the back of the face element. The side frame parts are hinged along the sides of the rectangular opening, extend under the sides of the carrier and illustration and are held against the back of the carrier by flexible tabs extending from the carrier. When the carrier tab is pulled upward the bottom frame part unfolds upward, the top edge of the carrier pushes the top frame part inward and the carrier pushes the side frame parts into their in use positions. The tabs on the carrier engage notches in the side frame parts to hold the assembly in its in use state.

5 Claims, 3 Drawing Sheets

CARD ASSEMBLY WITH COLLAPSIBLE FRAME

BACKGROUND OF THE INVENTION

1. Field

The subject invention is in the field of greeting cards and also the field of folded paper products mechanisms, particularly those used in greeting cards, valentines, "pop-up" cards and display frames.

2. Prior Art

It has long been understood that illustrations are significantly enhanced by certain types of framing, particularly beveled frames which extend at an angle of approximately 135° from the surface of the illustration. It has also been understood that a greeting card with a static frame of this type would be too bulky to be economically satisfactory. Accordingly, the primary objective of the subject invention is to provide a greeting card assembly which has a beveled frame but which folds flat for purposes of storage and mailing. A second objective is that the card assembly be convertible from its flat state to its in use state by one specific operation by a user, as different from requiring simply the opening of a cover on the assembly or requiring several steps to make the conversion. Other objectives of the invention will become apparent from the following descriptions of the invention.

SUMMARY OF THE INVENTION

The subject invention is a card assembly which has a flat state for mailing and storage and an in use state in which the illustration, i.e. artwork, photograph, text, etc., of the assembly is framed by a beveled frame. The term beveled, for purposes of this disclosure, means that the parts of the frame are at angles to the surface of the illustration. In preferred embodiments the flat, visible surfaces of the frame parts (i.e. top, bottom and sides) are at angles to the surface in the range of 90° to 180°, with 135° preferred. The assembly is converted from its flat to in use states in a single operation in which a user grasps a tab in between thumb and finger of one hand, restrains the assembly with the other hand, and moves the tab and part to which it is attached a short distance. Or, the transition can be effected by pushing on the part from which the tab extends.

The assembly comprises (1) a rectangular (including square) carrier with the illustration attached having a top, bottom and two sides, and (2) a generally planar or flat face element having a rectangular opening of the same proportions as those of the illustration but larger than the illustration by amounts as dictated by the mechanical requirements and design of the assembly. The bottom end of the carrier ks attached to the bottom of the rectangular opening by the bottom part of the frame, this part being hinged at its longer edges to the carrier and the face element. All hinges can be creases in or partial severances of the materials used in the assembly. This attachment orients the carrier and its movement relative to the face element. The top part of the frame is hinged to the top of the rectangular opening and extends generally toward the bottom of the opening for a distance greater than the width of the frame part. There is a slot in this top frame part, parallel to the top hinge line and located at the inner edge of the portion of this part that becomes the actual top part of the frame. A tab extends lengthwise upward from the top end of the carrier. The tab extends through the slot from what becomes front-to-back of the top frame part. When the tab is pulled the carrier moves a distance as described below and the end of the carrier engages the top part such that further motion of the tab moves the top part into its angled in use position. In its flat state the bottom part of the frame lies against the back of the face element. As the carrier is moved by force on the tab the bottom part swings through 90°, at which point the top of the illustration carrier engages the top frame part and further motion rotates both top and bottom frame parts 45° into their angled in use states (on the assumption that the bevel angle of the frame is 135°).

The side parts of the frame are hinged from portions adhesively attached to the back of the face element. The side parts extend the extremes of the top and bottom portions. The side parts press against the top and bottom parts and, as the top and bottom parts are moved into their in use states, the side parts swing from their flat states into their angled in use states.

Each side of the carrier has a tab which overlaps and slides along the edge of each of the side frame parts, the tabs deflecting as they slide along the edges. As the carrier reaches the point at which the frame parts move into the in use states, the tabs snap into notches in the edges of the side frame parts, locking the assembly in its in use state. In this state the illustration mounted on the carrier is framed by the frame parts. All the frame parts are shaped so that their ends adjoin with essentially no gaps.

In a second embodiment of the invention, auxiliary frame parts are adhesively attached to the basic frame parts. The auxiliary parts extend beyond the hinge lines between the frame parts and the face element. This effectively increases the width of the frame parts and thereby the depth of the frame, the depth being the distance between the plane of the illustration and the plane of the edges of the frame parts farthest from the illustration. This embodiment is particularly useful on larger sizes of the assembly.

In a third embodiment the frame parts are double folded in a way in which they stand out from the face element in the in use state. In this embodiment the frame formed by the basic parts is not mitered at the corners of the frame.

The so-called top and bottom parts of the assembly may be the side parts and the side parts the top and bottom parts. In such a configuration the motion needed to cause the transition from flat to in use states can be provided by connecting the carrier tab to a flap or cover so that opening the flap or cover provides the needed motion.

Other parts may be included in the assembly such as covers and supports.

The invention is described in more detail below with reference to the accompanying drawings.

DETAILED DESCRIPTION OF THE INVENTION

Figure 1:
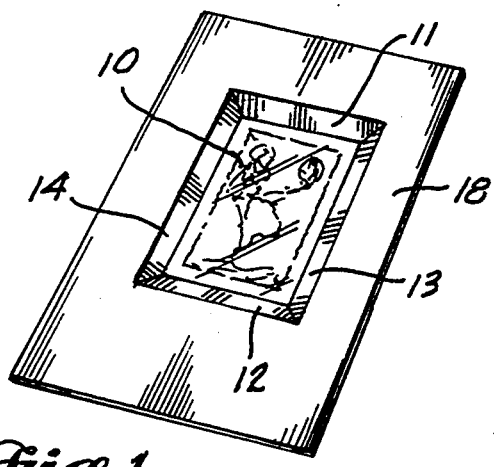
FIG 1 is a perspective view of a preferred embodiment of the invention in its in use state.
Figure 2:
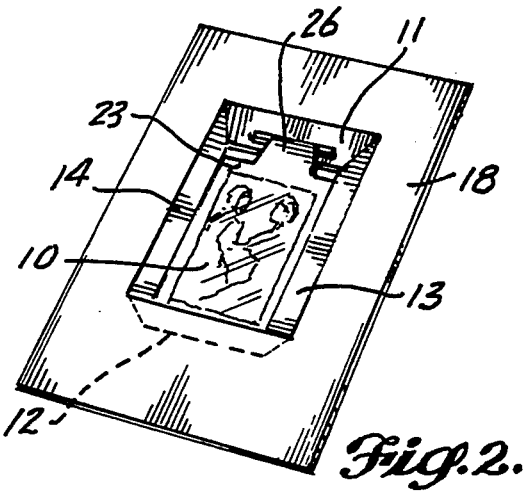
FIG 2 illustrates the embodiment of FIG. 1 in its flat state.
Figure 3:
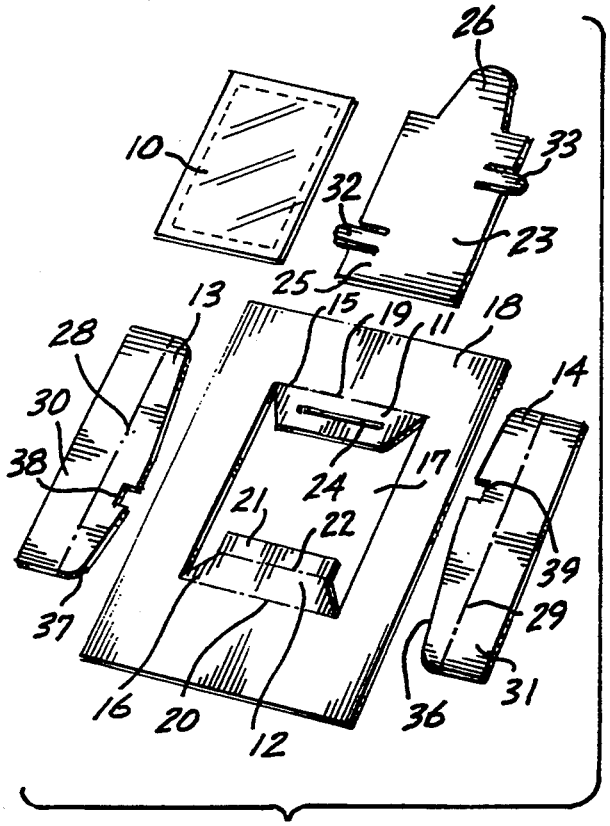
FIG. 3 is an exploded view of the basic parts of the subject invention.
Figure 4:
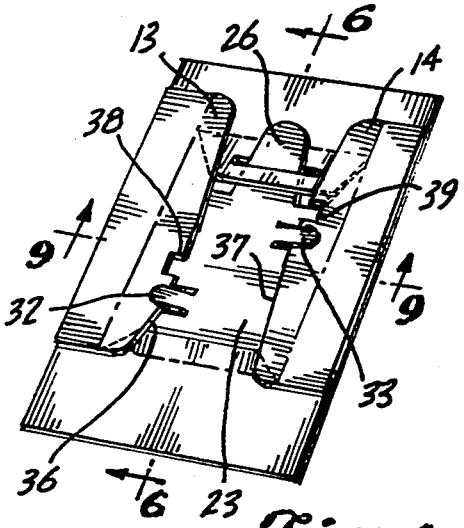
FIG. 4 is a perspective view of the components shown in FIG. 3 assembled and in their flat state, viewed from the backside of the assembly.

The subject invention is a greeting card assembly convertible from a flat state to an in use state in which the illustration in the assembly is framed by a beveled frame. A preferred embodiment of the invention is shown in FIG. 1 in its in use state. Illustration 10 is framed by top frame part 11, bottom frame part 12 and side frame parts 13 and 14, all having essentially the same width. FIG. 2 illustrates this embodiment in its flat state, bottom frame part 12 being folded under and therefore not visible in this view. FIG. 3 is an exploded view of the basic components of the subject invention. The top and bottom frame parts 11 and 12 are hinged at ends 15 and 16 of rectangular opening 17 in the substantially planar face element 18, the hinging being folds or creases or partial severances 19 and 20 respectively. Portion 21 hinged at crease 22 to the bottom frame part attaches this part to carrier 23 for the purposes described below. The top part extends beyond the portion visible in FIG. 1 and has slot 24 parallel to end and at the juncture of the illustration 15' and the top frame part in the in use state. The illustration is adhesively attached to the front face of the carrier. End 25 of the carrier is adhesively attached to portion 21. Tab 26 extending from the opposite end 27 of the carrier is passed through slot 24 as visible in FIG. 2. The side frame parts 13 and 14 are hinged at creases 28 and 29 to portions 30 and 31 respectively which are adhesively attached to the back side of the face element as illustrated in FIG. 4, a perspective view of the components shown in FIG. 3 in their flat state. Tabs 32 and 33, cut from and extending from side edges 34 and 35 of the carrier extend over edges 36 and 37 of the side frame parts. Edges 36 and 37 are contoured to accommodate the relative motions of the assembly and to guide the tabs along the edges until the tabs snap into and engage notches 38 and 39 to lock the assembly in its in use state as illustrated In FIG. 5.

Figure 6:
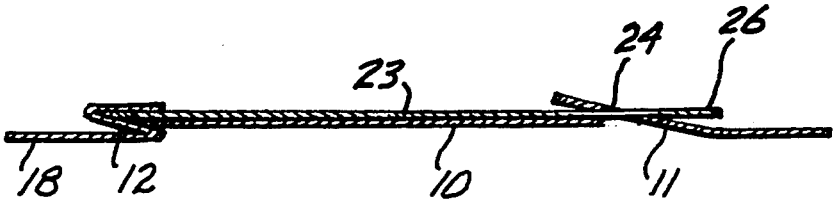
FIG. 6 is a section taken at 6—6 in FIG. 4.

FIG. 6 is a section taken at 6—6 in FIG. 4 and illustrates the orientation of the various parts and components as numbered in the flat state of the assembly.

Figure 5:
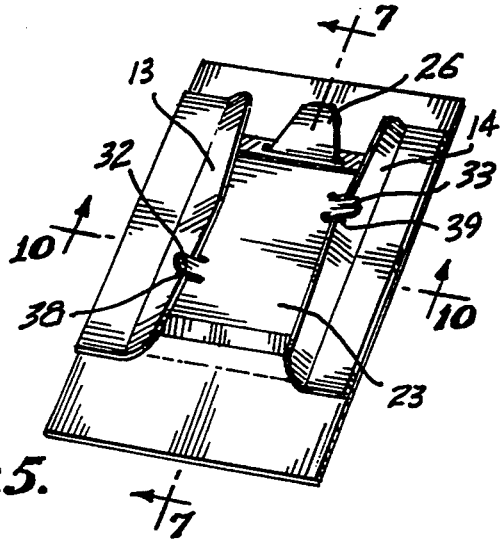
FIG. 5 is a perspective view of the parts shown in FIG. 3 assembled and in their in use state viewed from the back side of the assembly.
Figure 7:
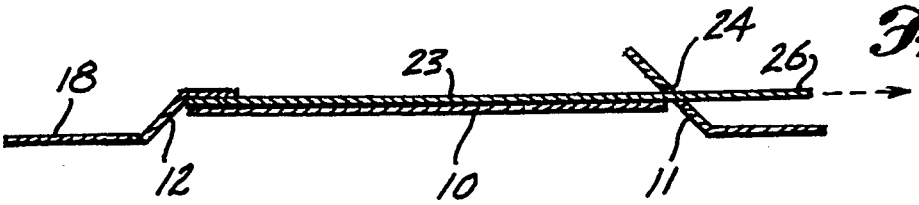
FIG. 7 is a section taken at 7—7 in FIG. 5.

FIG. 7 is a section taken at 7—7 in FIG. 5 showing the orientation of the various components and parts as numbered in the in use state of the assembly.

Figure 8:
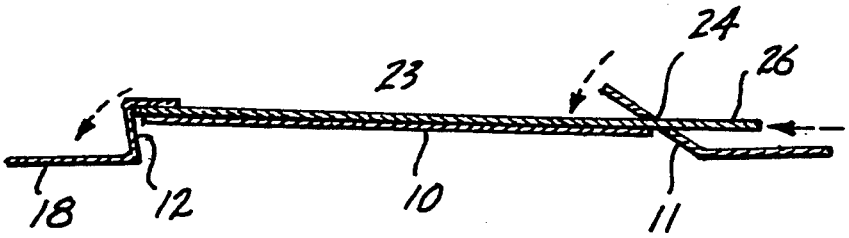
FIG. 8 is a section similar to those of FIGS. 6 and 7 but with the assembly in transition.

FIG. 8 is similar to FIGS. 5, 6 and 7 but shows the orientation of the various components and parts in a transitional state.

Figure 9:
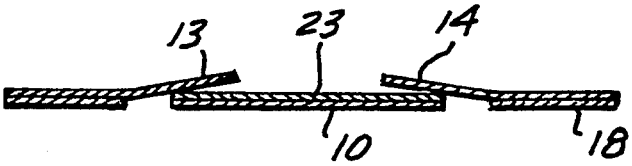
FIG. 9 is a section taken at 9—9 in FIG. 4

FIG. 9 is a section taken at 9—9 in FIG. 4, showing the orientation of the numbered parts and components in the flat state of the assembly.

Figure 10:
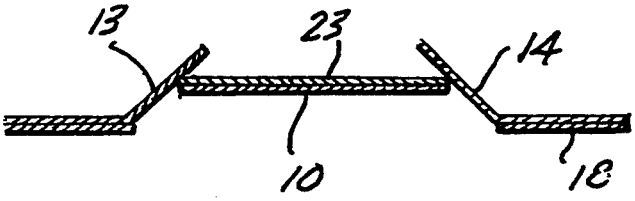
FIG. 10 is a section taken at 10—10 in FIG. 5.

FIG. 10 is a section taken at 10—10 in FIG. 5, showing the orientation of the various numbered parts and components in the in use state of the assembly.

As evident from these illustrations, pulling on the tab (or pushing on the bottom frame part) to move the carrier linearly with respect to the face element results in interaction of the involved elements and parts to convert the assembly from its flat state in which all frame parts are disposed substantially parallel to and close to the plane of the face element to its in use state in which each frame part is disposed at an angle to the face element.

Figure 11:
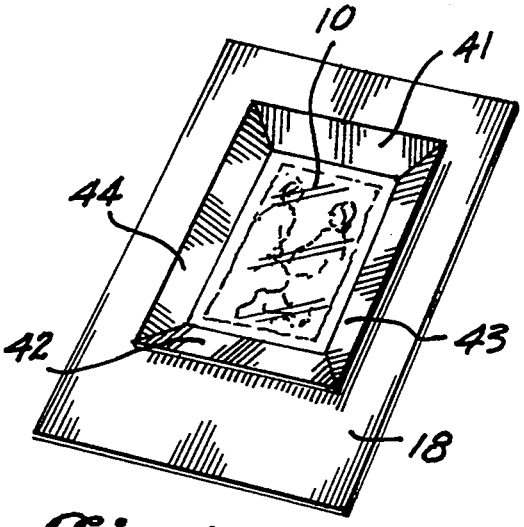
FIG. 11 is a perspective view of a second embodiment of the invention in its in use state.
Figure 12:
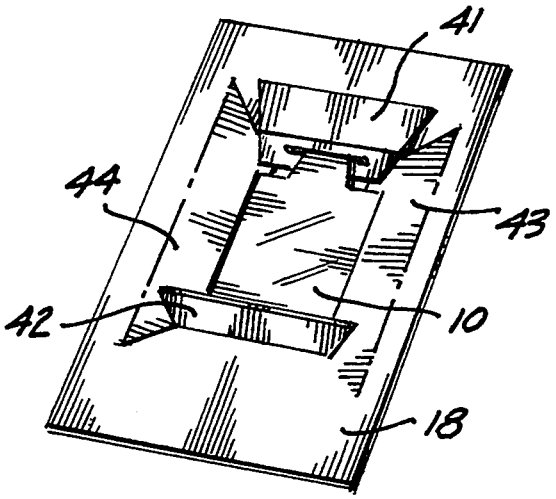
FIG. 12 is a view of the embodiment of FIG. 6 in its flat state.

FIG. 11 is a perspective view of a second embodiment of the subject invention. In this embodiment auxiliary frame parts 40, 41, 42 and 43 are adhesively attached to frame parts as described above. The auxiliary frame parts extend beyond the hinge lines of the base frame parts and provide a deeper frame for the illustration. FIG. 12 illustrates this configuration in its flat state.

Figure 13:
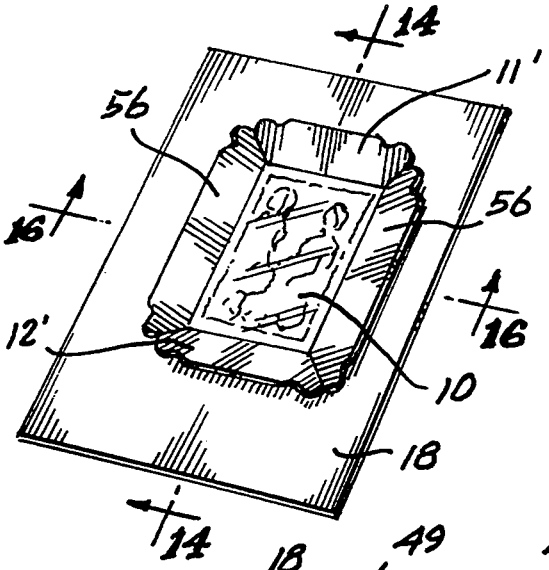
FIG. 13 is a perspective view of a third embodiment of the invention in its in use state.

FIG. 13 is a perspective view of a third embodiment of the subject invention. In this embodiment the frame parts stand out from the face element but are not mitered at the corners of the frame, corner 44 being typical.

Figure 14:
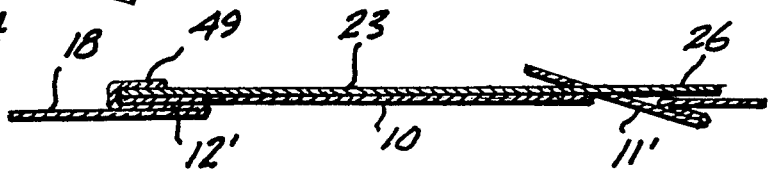
FIG. 14 is a section taken at 14—14 in FIG. 13 showing the embodiment shown in FIG. 13 in its flat state.
Figure 15:
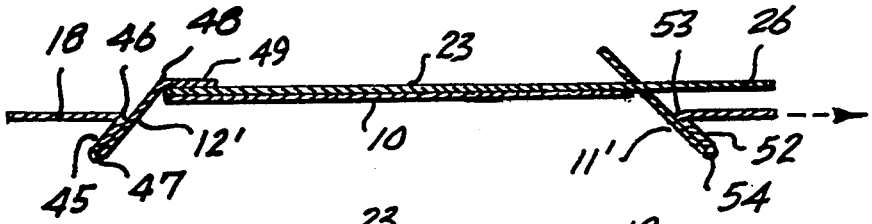
FIG. 15 is the section similar to that of FIG. 14 but showing the embodiment in its in use state.

FIG. 14 is a section taken at 14—14 in FIG. 13 showing the top and bottom frame parts of the FIG. 13 embodiment in its flat state. FIG. 15 is a section similar to that of FIG. 14 but showing the embodiment in its in use state. In this embodiment bottom frame part 45 extends beyond the partial severance hinge line 46 to edge 47 of the frame part where it is folded back on itself toward creased hinge 48 and portion 49 which is attached to end 50 of carrier 51. Top frame part 52 is configured to stand out from face element 53 by being folded back on itself at fold 54, the folded frame part being hinged to the face element at crease 55. In these frame part configurations the hinged connections of the parts to the face element are midway between the edges of the frame parts.

Figure 16:
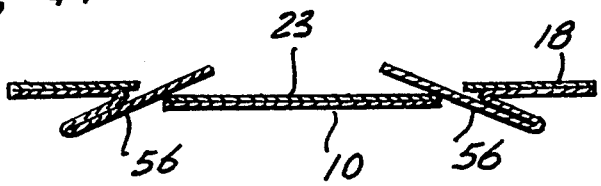
FIG. 16 is a section taken at 16—16 in FIG. 13 showing the embodiment in its flat state.

FIG. 16 is a section taken at 16—16 in FIG. 13 showing the embodiment in its flat state. The side frame parts, part 56 being typical, are adhesively attached to the back of the face element and extend beyond the face element 53 in the same configurations as top frame part 52.

The movement needed for transition of the assembly from flat to in use states may be provided by incorporating a flap or cover into the assembly and connecting the carrier to the cover/flap such that opening the cover or flap moves the carrier as needed.

It is considered to be understandable from this description that the subject invention meets its objectives. It provides a greeting card assembly which frames the illustration of the card with a beveled frame when the assembly is in its in use state. The assembly converts from a flat state suitable for mailing and storage. Its conversion from flat to in use state requires one specific action by the user other than opening a flat or the like. It is also easily manufactured.

It is also considered to be understood that while certain embodiments of the invention are described herein, other embodiments and modifications of those described are possible within the scope of the invention which is limited only by the attached claims.

I claim:

1. A card assembly comprising:

generally planar face element having a front and back and a rectangular hole having a top edge, bottom edge and first and second side edges, a top frame part hinged to said top edge, a bottom frame part hinged to said bottom edge, first and second side frame parts hinged to said first and second side edges respectively, each of said top, bottom and first and second frame parts being swingable relative to said face element between a fiat state disposed substantially parallel to and close to the plane of said face element and an in use state disposed at an angle to said face element, a carrier, an illustration carried by said carrier, said carrier being attached to said bottom frame part and interactively in contact with said top and said first and second side frame parts such that moving said carrier swings each of said frame parts from said fiat state to said in use state.

2. The assembly of claim 1 in which each of the top, bottom and first and second side frame parts has a first width, said assembly further comprising auxiliary top, bottom and first and second side frame parts attached, respectively, to said top, bottom and first and second frame parts, each of said auxiliary frame parts having a second width greater than said first width.

3. The assembly of claim 2, further comprising means for locking the frame parts in their in use states.

4. The assembly of claim 2 in which each of the top, bottom and first and second side frame parts has a first width, said assembly further comprising auxiliary top, bottom and first and second side frame parts attached, respectively, to said top, bottom and first and second side frame parts, each of said auxiliary frame parts having a second width greater than said first width.

5. The assembly of claim 1 in which each of said frame parts has a first edge and a second edge, is connected by a hinged connection to said face element and is configured such that said hinged connection is between said first and second edges.

* * * * *